US005641316A

United States Patent [19]

Bakalis

[11] Patent Number: 5,641,316

[45] **Date of Patent: *Jun. 24, 1997**

[54] WEBBED GLOVE FOR CONTROLLING MOVEMENT OF A WEARER'S HAND THROUGH A FLUID

[76] Inventor: Konstantine G. Bakalis, 1443 78th St., Brooklyn, N.Y. 11228

[ * ] Notice: The portion of the term of this patent subsequent to Oct. 18, 2011, has been disclaimed.

[21] Appl. No.: 317,281

[22] Filed: Sep. 15, 1994

Related U.S. Application Data

[63] Continuation-in-part of Ser. No. 135,477, Oct. 13, 1993, Pat. No. 5,356,322.

[51] Int. Cl.[6] ..... A63B 31/02

[52] U.S. Cl. ..... 441/57; 441/58

[58] Field of Search ..... 441/55, 56, 57, 441/58

[56] References Cited

U.S. PATENT DOCUMENTS

| | | | |
|---|---|---|---|
| 689,840 | 12/1901 | Jensen | 441/57 |
| 819,852 | 5/1906 | Christopher | 441/57 |
| 1,014,939 | 1/1912 | Boman . | |
| 1,275,005 | 8/1918 | Eckman | 441/57 |
| 3,023,432 | 3/1962 | Loomis . | |
| 3,231,910 | 2/1966 | Tegland . | |
| 3,257,673 | 6/1966 | Rademacher . | |
| 4,058,863 | 11/1977 | Ferdico | 441/57 |
| 4,121,312 | 10/1978 | Penny | 441/57 |
| 4,195,365 | 4/1980 | Eyman et al. . | |
| 4,548,588 | 10/1985 | Kosuge | 441/57 |
| 4,618,328 | 10/1986 | Chi . | |
| 4,669,991 | 6/1987 | Southworth . | |
| 4,923,418 | 5/1990 | Hoffman . | |
| 5,004,227 | 4/1991 | Hoffman . | |
| 5,356,322 | 10/1994 | Bakalis | 441/58 |

FOREIGN PATENT DOCUMENTS

| | | |
|---|---|---|
| 1514778 | 1/1968 | France . |
| 2617727 | 1/1989 | France . |
| 284111 | 1/1928 | United Kingdom . |

*Primary Examiner*—Stephen Avila

[57] ABSTRACT

A glove includes webs connecting adjacent phalange-covering sections together. Each web includes a groove for increasing the flexibility of the webs whereby a user can close his or her hand into a grasping fist and the webs will bow outwardly to permit this movement. Fins on the glove are located to be on the back of the wearer's hand when the glove is in position on that hand. Each of the fins is formed of one or more materials and can be formed of one or more sections and operate to guide movement of the hand through a fluid, such as water. A closure is located on a wrist-covering portion of the glove and secures the glove snugly about the wearer's wrist. The glove includes ribs on the palm side thereof, and the ribs can be multi-sectioned and/or formed of several different materials to increase the flexibility of the glove.

17 Claims, 7 Drawing Sheets

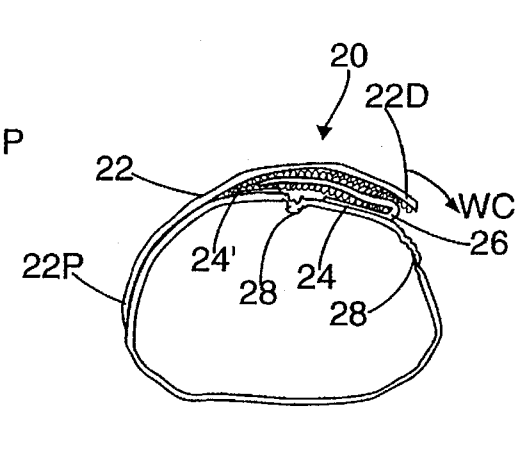
FIG. 4c
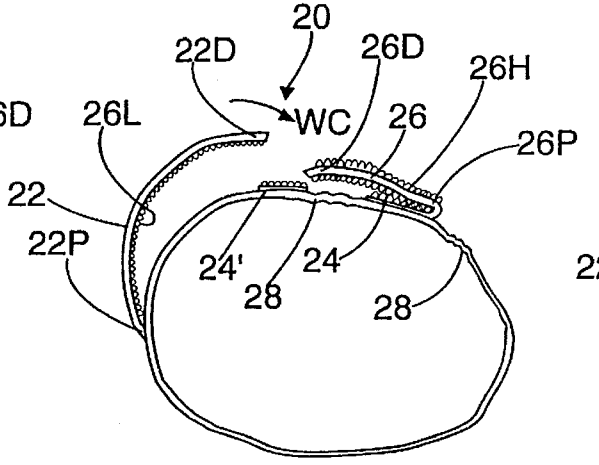
FIG. 4b
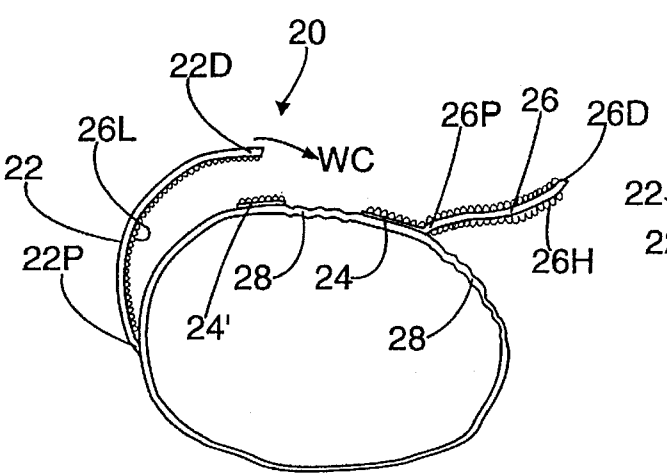
FIG. 4a
FIG. 5c
FIG. 5b
FIG. 5a

WEBBED GLOVE FOR CONTROLLING MOVEMENT OF A WEARER'S HAND THROUGH A FLUID

REFERENCE TO RELATED APPLICATION

The present application is a Continuation-In-Part of Ser. No. 08/135,477 filed on Oct. 13, 1993, now U.S. Pat. No. 5,356,322 the disclosure of which is incorporated herein by reference.

FIELD OF THE INVENTION

The present invention relates to the general art of aquatics, and to the particular field of swimming.

BACKGROUND OF THE INVENTION

The benefits of swimming have long been appreciated. Modern emphasis on physical fitness has increased the number of swimmers, both recreational and competitive. These swimmers often use various aids to increase either their enjoyment of the sport or to improve their swimming skills. These aids often take the form of added weight or added resistance or stroke-specific devices.

For this reason, the art includes many devices, such as wrist weights, kickboards, leg donuts, and the like, that are intended for use by swimmers to increase their swimming skills. Even with number of swimming accessories known in the art, there is still room for further improvement.

Any device used to improve swimming skills should not be too difficult or strenuous to use. If it is, it will not enjoy wide commercial acceptance. Still further, if the device is too strenuous, it may create a danger of injury due to overtaxing the user's body.

Therefore, there is a need for a swimming skill improvement device that can be used by swimmers of all skill levels and which will improve the skill of the user without too much stress being placed on the swimmer's muscles or joints.

Still further, a useful swimming aid should encourage a proper stroke. Many known swimming aides may assist one portion of the overall stroke, such as the arm movement, while changing another portion of the stroke, such as body position, in an adverse manner. Therefore, there is a need for a swimming aid that will assist the swimmer in developing his or her skills, yet will not cause other portions of the swimming stroke to change in an adverse manner.

Still further, any swimming aid should not be susceptible to becoming loose or deteriorating after long periods of use. Some swimming aids tend to loosen or deteriorate after time due to the harsh effects of the water, especially heavily chlorinated water. Therefore, there is a need for a swimming aid that can be used for long periods of time without deterioration or degradation.

Still further, the inventor recognizes that some swimming aids will be used in situations for which they may not be designed. An example of such misuse may occur when a swimmer dives into a pool with a kickboard, or with pull buoys on. Therefore, any swimming aid should not endanger a user even if misused. Consequently, there is a need for a swimming aid that can be misused without unduly endangering the user.

The inventor also notes that competitive or recreational swimming is only a small portion of the overall field of aquatic-related sports. SCUBA, snorkeling, surfing and the like are also extremely popular activities. These activities, like the swimming activities discussed above, have the same constraints and requirements for perfecting proper stroke technique. Therefore, there is a need for a device that can be used by swimmers as well as others engaged in various aquatic sports to improve their techniques without adversely affecting other portions of their strokes or placing too much stress on their bodies.

The inventor also notes that even skydivers require practice to develop proper techniques.

Still further, many people who use gloves of this sort, wear them while using their hands for purposes other than swimming. For example, a SCUBA diver may wish to examine a specimen that he or she discovers, or a swimmer may wish to grasp an object of some sort. For this reason, many gloves that are used in swimming are unpopular because these gloves inhibit the grasping of objects when the user is wearing the glove. Even if a user could grasp an object, the glove may be wet and slippery thereby increasing the possibility of dropping a grasped object. Still further, the glove should be flexible enough to permit a wearer to easily manipulate his or her hand. Heretofore, some gloves were not flexible enough to permit such action and thus were not commercially acceptable. Therefore, there is a need for a swimming glove that facilitates grasping and securely holding objects while wearing the glove.

Still further, many swimmers, especially SCUBA divers, often wish to carry objects, such as knives, depth meters, or the like, with them. Some of these objects may be carried during swimming, while others, such as a watch, may be useful at other times. However, the elements used to carry these objects should not be cumbersome or overly-restrictive during swimming. Therefore, there is a need for a glove that can be worn during swimming and can accommodate accessories that may be useful to a swimmer without being overly cumbersome or restrictive.

It is noted that while the present invention will be disclosed in conjunction with swimming, it is to be understood that it is equally applicable to use by a person moving through any type of fluid where proper hand movements should be developed. Thus, it is to be understood that the disclosure of swimming is merely for convenience and is the best mode, but is not to be taken as limiting the scope and coverage of this disclosure to swimming alone.

OBJECTS OF THE INVENTION

It is a main object of the present invention to provide a device that can be used to develop and perfect hand movement as a user moves through a fluid.

It is another object of the present invention to provide a device that can be worn by a swimmer yet will permit that wearer to easily manipulate his or her hand.

It is another object of the present invention to provide a device that can be worn by a swimmer yet will permit that wearer to securely grasp and hold an object.

It is another object of the present invention to provide a device that can be used to develop and perfect hand movement as a user moves through a fluid that is efficient and not overly-stressful to use.

It is another object of the present invention to provide a device that can be used to develop and perfect hand movement as a user moves through a fluid that will improve hand movement without adversely affecting other portions of a stroke.

It is another object of the present invention to provide a device that can be used to develop and perfect hand movement as a user moves through a fluid that will improve hand movement and will not degrade after long use.

It is another object of the present invention to provide a device that can be used to develop and perfect hand movement as a user moves through a fluid that improve hand movement and that will can be securely fastened to a user even after long periods of use.

It is another object of the present invention to provide a swimming aid.

It is another object of the present invention to provide a swimming aid that will develop and perfect a swimmer's hand movements.

It is another object of the present invention to provide a device that can be used to develop and perfect hand movement as a user moves through a fluid and that will improve such hand movement yet will not unduly endanger a user if misused to dive into a body of water, for example.

It is another object of the present invention to provide a device that can be worn by a swimmer and can also support other objects that might be carried by a swimmer without being overly-restrictive or cumbersome.

SUMMARY OF THE INVENTION

These, and other, objects are achieved by a webbed glove that has flow control fins thereon and grooves defined therein in a manner that permits the glove to collapse to facilitate grasping an object. The glove further includes grasping enhancing means thereon for enhancing the ability of a wearer to hold onto an object that is being grasped. The glove further includes size adjusting means that also tightly locks the glove onto the hand of the user yet is easy to manipulate. The fins are designed to encourage proper hand movement and proper resistance to hand movement whereby proper hand movement technique can be practiced without unduly taxing the swimmer. The fins are designed, located, sized and configured to induce proper hand movement without adversely affecting the rest of the arm movement or any other part of the swimming stroke, and designed to work with the grooves and the grasping enhancing means to not only enhance hand movement but also facilitate grasping.

In this manner, the swimmer can improve his or her hand movements without endangering any other portion of the stroke or placing too much resistance on the hand movements to unduly tax the swimmer, while also easily and securely grasping objects while still wearing the glove.

The webbed glove is formed of several plies of material in which the fins are firmly anchored but can give, if the swimmer dives into the water with the glove on, and the glove is durable yet comfortable for long wearing times. Alternatively, the fins can be one-piece with the rest of the glove. The glove also has size adjusting means that will permit a snug fit to be established even if the glove becomes slightly worn thereby lengthening the effective life of the glove.

BRIEF DESCRIPTION OF THE DRAWING FIGURES

FIGS. 4A–4C show use of the closing means on the first form of the glove.

FIGS. 5A–5C show use of the closing means on the second form of the glove.

DETAILED DESCRIPTION OF THE PREFERRED EMBODIMENT OF THE INVENTION

Figures 1, 2:
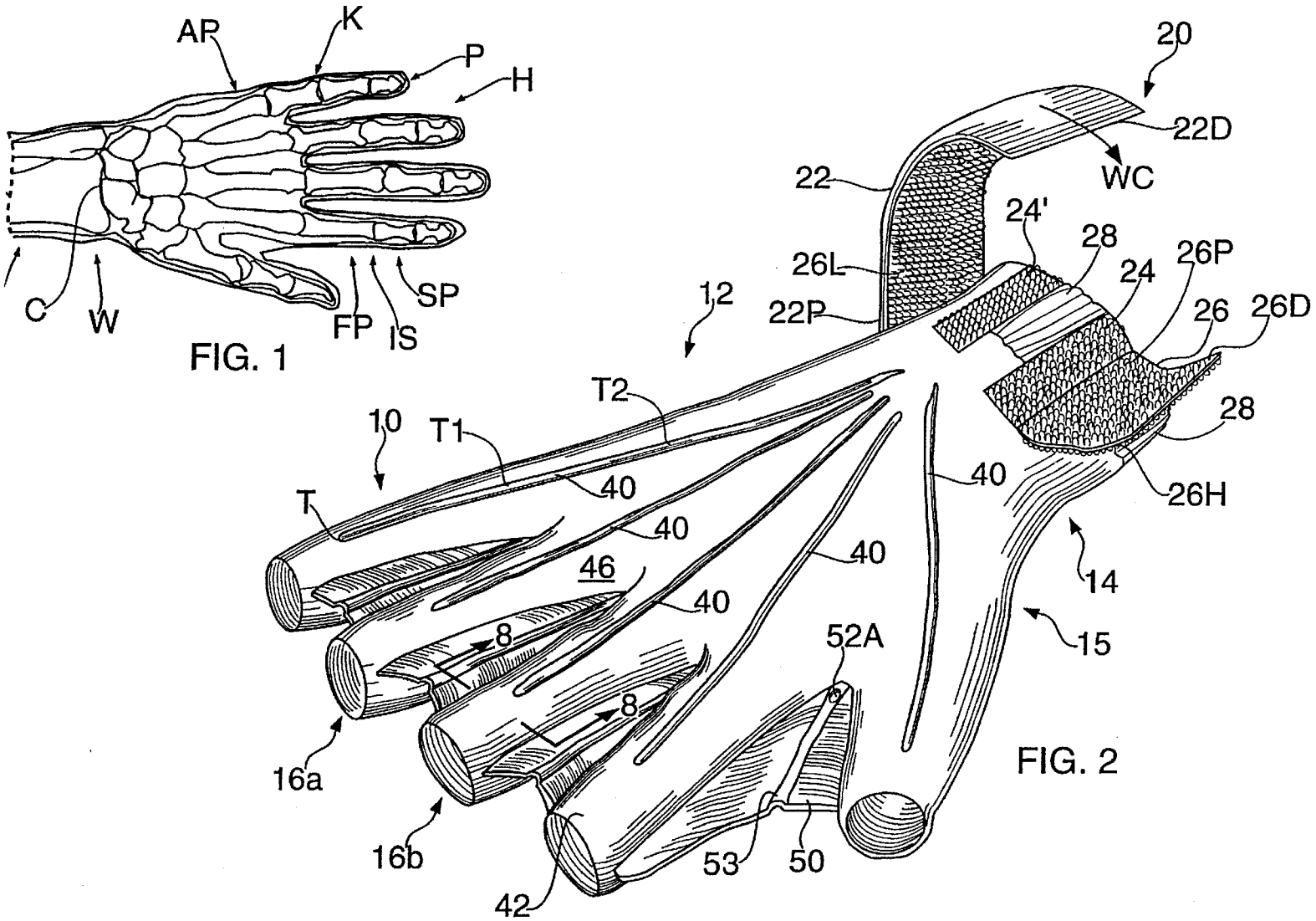
FIG. 1 illustrates a human hand for the purpose of orienting a reader to the terminology used herein.
FIG. 2 is a front, top and side perspective view of a first form of the webbed glove of the present invention.

Shown in FIG. 1 is a human hand H that includes a plurality of phalanges P, each of which includes a first, proximal row of phalanges FP joined to a second row of phalanges SP by a joint (knuckle) K. The hand is joined to a forearm F at a wrist W where the forearm ulna and radius bones join the bones associated with the hand.

Shown in FIG. 2 is a first form of a webbed glove 10 embodying the present invention. The webbed glove is intended to be worn on either hand or on both hands, and a right-handed glove is shown for the sake of convenience only. The preferred form of the glove covers the user's hand from above the wrist, over the body or palm of the hand and over the phalanges. The preferred form of the glove covers the first, or proximal row of phalanges, but the glove can be extended to cover the second row of phalanges up to the joint (knuckle) connecting those second row of phalanges to the third or distal row of phalanges, or can cover the entire hand so the distal ends of the fingers are covered. Thus, the glove includes a body portion 12 having a wrist covering portion 14 on one end and a phalange covering portion 16 on the other end.

As shown in FIG. 2, the glove includes a closure means 20 on the wrist portion. Closure means 20 includes a first hook-and-loop fastener section 22 that is mounted at its proximal end 22P on glove body 12 and has a distal end 22D spaced therefrom to move in a wrist-covering movement indicated by arrow WC. Section 22 co-operates with a second hook-and-loop fastener section 24 to ensure a tight fit of the glove on a user's hand. Closure means 20 further includes a second strap 26 that is mounted at its proximal end 26P on body 12 and has a distal end 26D spaced therefrom. Hook and loop material 26H and 26L is located on the strap 26 and on strap 22 respectively to fasten strap 26 to strap 22. Material 26L can be located on body 12 adjacent to proximal end 22P if desired. The glove body includes a flexible portion 28 that can be pleated or which is simply more flexible than the remainder of the glove body. During closing of closure means 20, portion 28 is compressed as indicated in FIG. 4B to initially close the glove over the user's wrist. Strap 22 is stretched over the user's wrist in direction WC and is attached to fastener means 24 as shown in FIGS. 4A and 4B. Then, strap 26 is stretched over this closed strap as shown in FIG. 4C with fastener means 26H being connected to fastener means 26L. The combination of the hook-and-loop fastener sections and the compressible section 28 securely places the glove on a user's hand, and can be used to compensate for any degradation of the glove over time. The wrist portion extends up the user's wrist past area A indicated in FIG. 1 and well beyond the ends of the ulna and radial bones shown in FIG. 1 by carpals C, to add support to the wrist in the event the user dives into water while wearing the glove. The preferred form of the glove extends beyond the carpals by at least three inches. The added wrist support prevents injury to the wearer's wrist by supporting the hand from being bent backwards too far. The tight closure means also assists in this protection as it supports the wrist. Thus, the wrist-covering portion extends above the wearer's wrist joint to partially cover the radius bone of the wearer's forearm above the first row of carpal bones in the wearer's hand.

Figure 3:
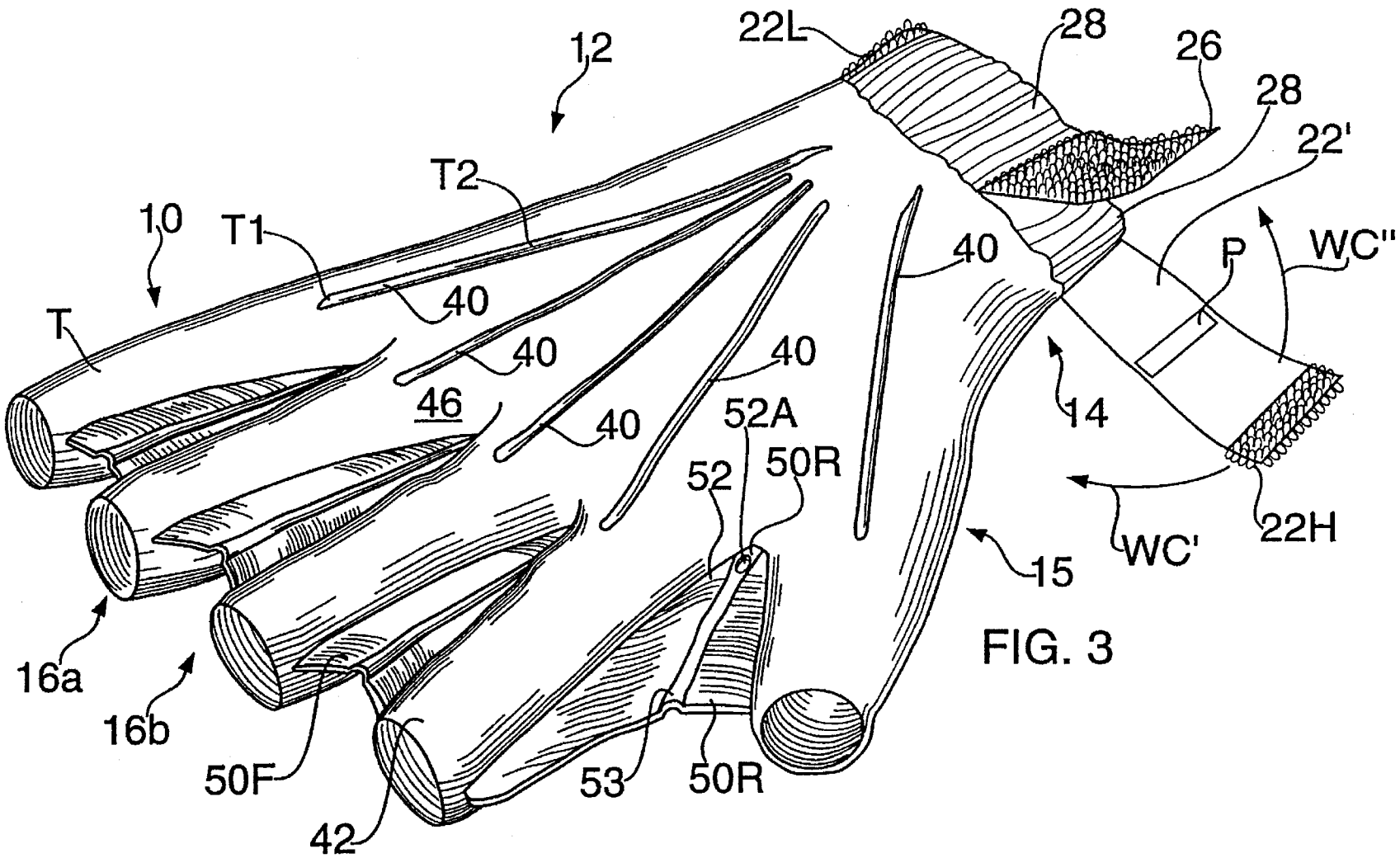
FIG. 3 is a front, top and side perspective view of a second form of the webbed glove of the present invention.

An alternative form of closure means 20 is shown in FIG. 3 in which strap 22' is located on the other side of the user's wrist with respect to strap 22, and moves in direction WC' or WC" to close means 20. Hook-and-loop fastener means includes means 22H on strap 22' and means 22L on glove body 12. As shown in FIGS. 5A through 5C, strap 26 is closed after compressing portion 28 in the manner discussed above. Then, strap 22' is moved in either direction WC' or WC" and connected to glove body 12 using hook-and-loop closure means that are on the proper surface of strap 22' and either the glove body or the strap 26. The dual straps ensure tight, secure closing of the glove at all times. It is also noted that a pocket P can be located on one of the straps to contain any suitable equipment or accessories, such as a watch, or the like, that a swimmer may desire to carry with him without making the glove overly-cumbersome. The position of the pocket on the wrist permits the swimmer to carry these accessories in an easily accessible location that is also out of the way during swimming or other activities.

Figure 8:
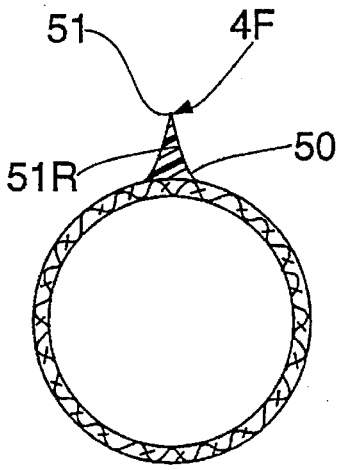
FIG. 8 is a sectional view taken along line 8—8 of FIG. 2 showing the transverse configuration of a fin.
Figure 9:
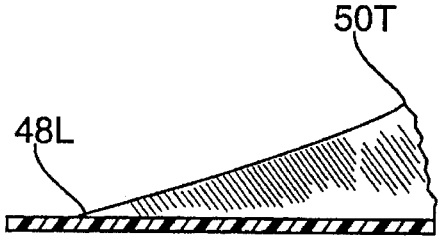
FIG. 9 illustrates a side elevational view of a portion of a fin to show the sloping nature of the top edge thereof.
Figure 10A:
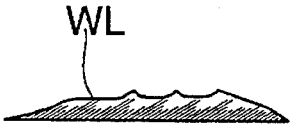
FIGS. 10A–10C show various forms for an irregular top edge of a fin.
Figure 10B:
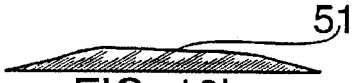
Figure 10C:
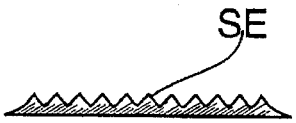

As can be best seen in FIGS. 2 and 3, the glove includes a plurality of fins 40 that, in one form, extend from adjacent a distal end of each phalange-covering section, such as section 42, to adjacent to closure means 20. The fins are located to be on the back of the wearer's hand when the glove is on that wearer. The orientation of the fins with respect to each other and with respect to the glove has been found to assist in further controlling hand movement through the water. The fins are formed of aluminum, preferably, Aluminum alloy 3003-H14 or 6061-T6, and rise above outer surface 46 of the glove. Alternatively, the fins can be molded as one whole piece with the same material. The fins are streamlined, as best shown in FIGS. 8 and 9, to taper downwardly from an apex 48 to a foot 50, and rearwardly from a leading edge 48L to a trailing edge 50T. At the maximum height above the glove surface, the fins are tall enough, as measured between the apex and the foot, to control movement of a user's hand through a fluid, yet are flexible so undue control of that movement is not exercised. It has been found that a maximum fin height of 3/16 inch and a fin width as measured at the foot of the fin, of 3/16 inch achieves this desired result for the aluminum material. The fins can include an irregular top edge 51 that includes long waves, such as WL shown in FIG. 10A, or serrated edges SE shown in FIG. 10C. Of course, the top edge 51 can be smooth as shown in FIG. 10B, or the top edge can be rounded as indicated at 51R in FIG. 8.

Still further, the fins can extend from adjacent to distal end 42 or can terminate adjacent to any of the knuckle areas including area 15, SP or AP shown in FIG. 1. These termination locations for terminal end T of the fins is selected to fit the desired flexibility of the glove. In fact, the fins can include a first portion T1 that is flexible, such as cloth, and a second portion, such as T2 that is metal to further enhance the flexibility of the glove. Other shapes, forms and dimensions of the fins will occur to those skilled in the art based on the teaching of this disclosure, and the just-mentioned forms, shapes, dimensions and materials are merely the preferred form of the invention, and are not intended to exclude other materials, shapes, forms and dimensions to satisfy special needs and requirements, such as may be associated with various swimming strokes (freestyle, backstroke, butterfly and breaststroke), as will occur to those skilled in the art based on the teaching of this disclosure. The fins can be formed of a plurality of materials, including the materials disclosed above in combination with each other or in combination with other materials as is necessary to provide a glove that is flexible yet has guiding fins thereon.

Figure 6A:
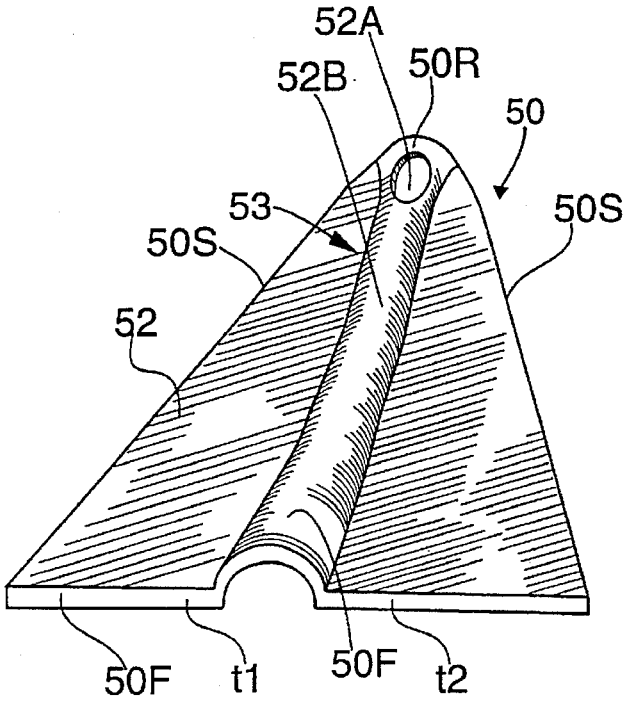
FIGS. 6A and 6B show the web with a groove defined therein, with FIG. 6A showing the web in the fully extended position and FIG. 6B showing the web in the closed position which will be assumed when a wearer closes his or her hand around an object, with the groove closing to permit the web to bulge thereby permitting a wearer to close his or her fingers into a grasping position.
Figure 6B:
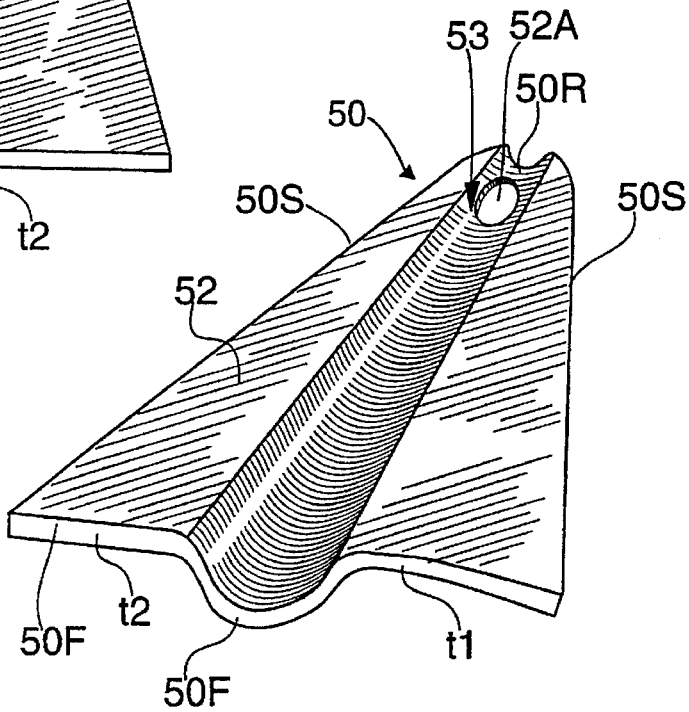
Figure 7:
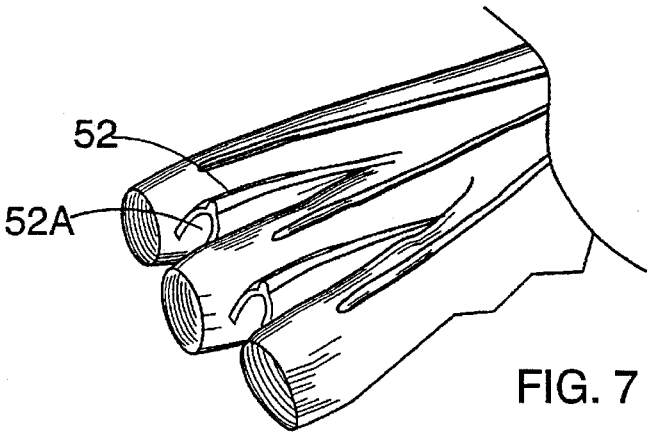
FIG. 7 shows a portion of the glove in the grasping, web bulging, configuration.

As is also shown in FIGS. 2 and 3, the glove includes webs, such as web 50, connecting adjacent phalange-covering sections, such as sections **16*a* and 16*b*. All of the webs are similar, and thus only web 50 will be described. Web 50 is also shown in FIGS. 6A and 6B, and includes a body section 52 that, preferably is 3/16 inch thick, and has a flow hole 52 defined therethrough. As shown, each web also includes a groove 53 that extends from front end 50F to rear end 50R of each web. The grooves are all identical, so only groove 50 will be discussed. Groove 50 is contoured to be concave as viewed from the palm side of the glove and has a thickness that is thinner than the adjacent thickness of the web as can be seen by comparing thicknesses t1 and t2 in FIG. 6A whereby groove 52 has an arcuate wall 52A on the top side of the web opposite to the palm side thereof. As shown, the web distal ends are curved and the proximal ends are V-shaped to match the contour of the glove between adjacent phalanges. The shape and orientation of the grooves permit the web to compress when a user makes a fist so that force is exerted on the groove from sides 50S toward the groove so the user can press his or her fingers together as shown in FIG. 7** with the web popping up as shown. This facilitates grasping of objects. If desired, the flow holes can be omitted.

The preferred form of the glove includes a plurality of plies, or layers as was discussed in the parent application, Ser. No. 08/35,477, filed on Oct. 13, 1993, the disclosure of which is incorporated herein. Preferably, the glove includes an inner layer of neoprene rubber covered with an outer layer of rubberized nylon. The material for inner layer is selected to be comfortably worn on a user's skin for long periods without chaffing or the like. Fins 40 are anchored in inner layer and extend through outer layer. The glove can also be made with a neoprene material that has loose fibers mixed in it that will allow for maximum strength and also thinner layers. The material is mixed, compressed and molded to specification in a compression mold.

Figure 11A:
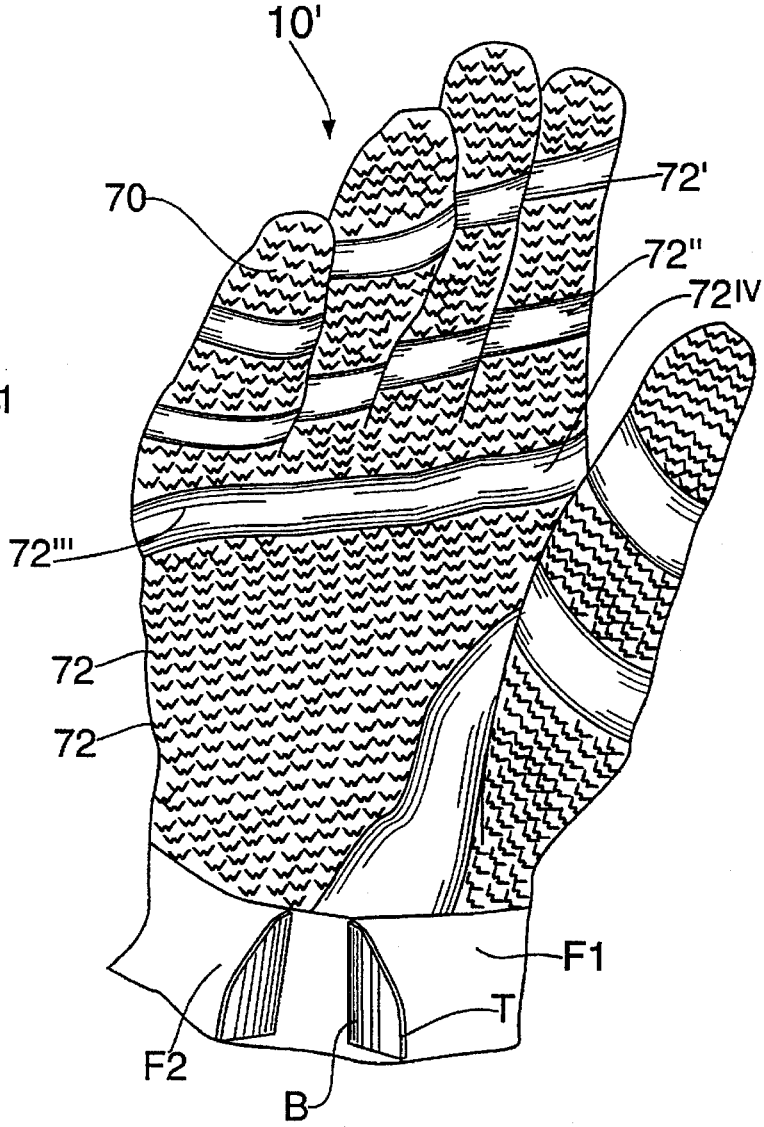
FIGS. 11A–11C are palm side views of gloves showing grasping enhancing means thereon.
Figure 11B:
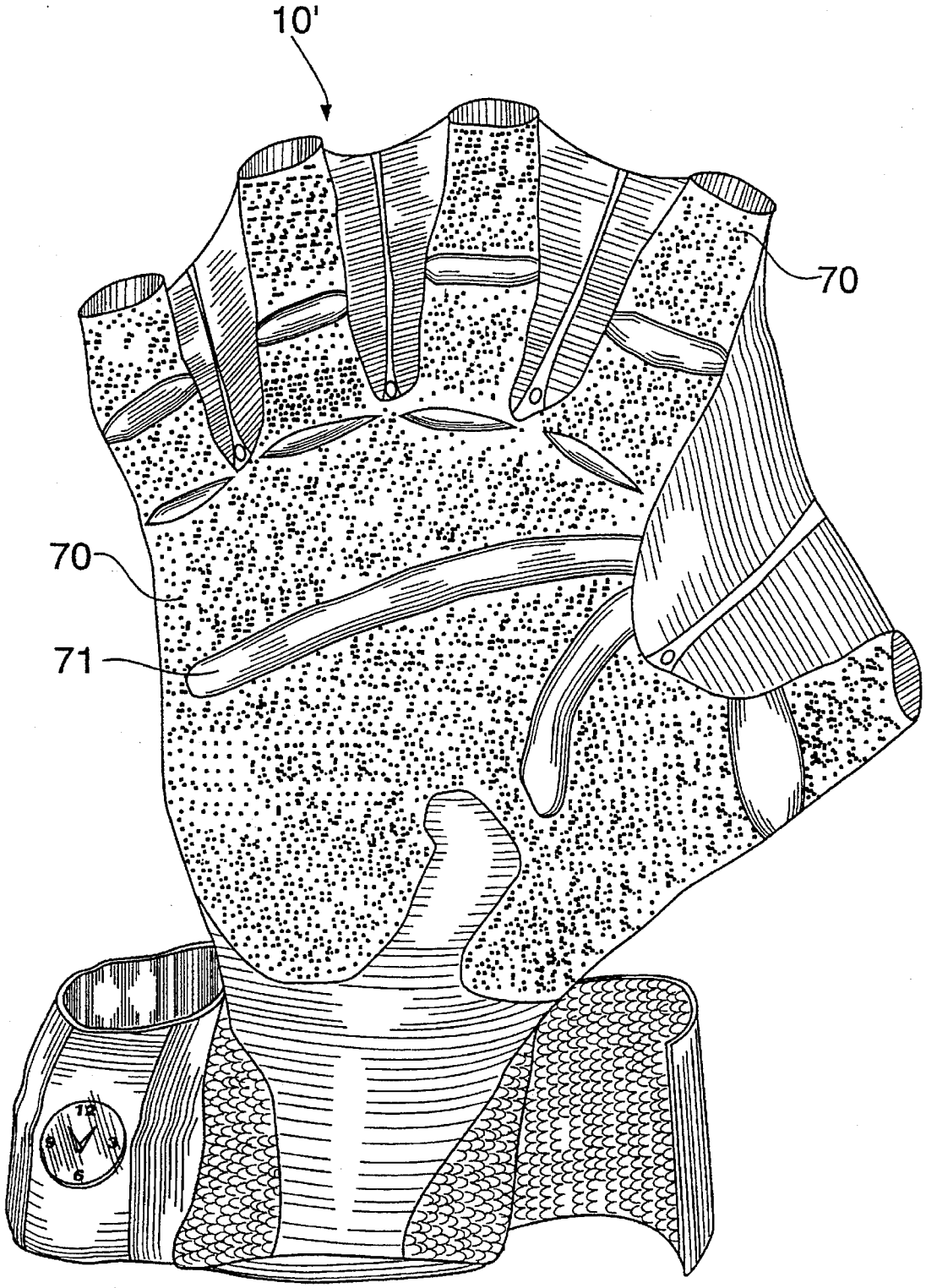
Figure 11C:
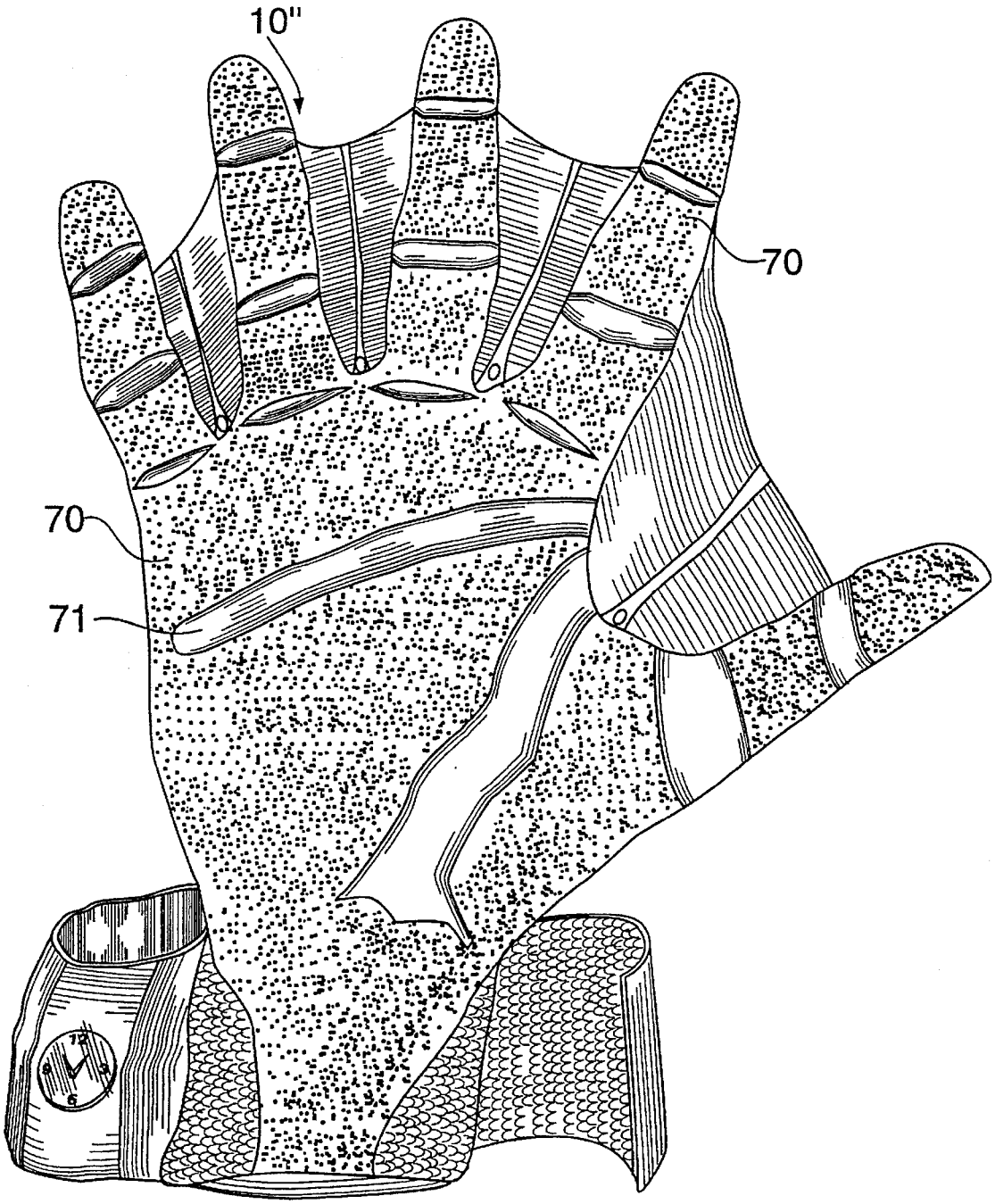

An alternative form of glove 10 is shown in FIGS. 11A–C as gloves 10' and 10" which are identical to glove 10 but include grasping enhancing means 70 and smooth areas 71 for greater flexibility. Means 70 includes a plurality of irregular ribs, such as W-shaped rib 72, at various locations on the palm side of the glove. The ribs are preferably located in sections 72', 72", 72'", $72^{IV}$, and $72^{V}$. Other locations are also shown as indicated by the dotted areas, but these are the primary locations to facilitate grasping without unduly increasing stiffness of the glove. The ribs are continuous and the W-shape permits enhanced gripping. The W shape is shown in one orientation in FIG. 11, but other orientations can be used without departing from the scope of the present invention.

It is understood that while certain forms of the present invention have been illustrated and described herein, it is not to be limited to the specific forms or arrangements of parts described and shown, and other means and designs within the scope of the present disclosure can be used, such as loop mesh material for the glove body, spaces between sections T1 and T2, fins on the palm side of the glove and/or along the wrist portion thereof, and the like can be made without departing from the scope of the present disclosure. Furthermore, various methods of manufacturing the glove can be used, including compression molding, co-excursion, injection molding and dipping, and various materials, such as closed cell neoprene combined with loose fibers can be used. The flow holes can be circular or oval as desired, with circular being preferred. Still further, the number of fins can be four, each running the full length of the top portion from the first finger joint nearest to the knuckle of each finger to the beginning of the wrist area of the glove. As indicated in FIG. 11A, there can also be one or two fins on the bottom (F2) or side portion (F1) of the wrist area thus allowing for more properly executed swimming strokes, while also acting as a rudder and reducing drag. While the fins can be formed of several sections, they can also be formed of one single section and can include areas of differing flexibility and have slightly different edges to function and be used for dual purposes by the military. For example, the base portion of a fin, B in FIG. 11 can have more flexibility than a top portion T. As indicated in FIG. 9, the fins can be constructed to rise at the knuckle area and taper at the beginning of the wrist area at ¼" or ½" so as to not interfere with the wrist support when it is in place.

The construction of the glove can be achieved using a variety of different procedures. For example, compression molding, co-excursion molding, injection molding, and dipping can all be used individually or in combination. The preferred form of the glove is one-piece, that is monolithic in construction, and whatever fabrication process that is necessary to achieve this result will be suitable. The preferred material is closed cell neoprene combined with loose fibers so the glove can be thin but durable and strong while still being efficient to manufacture. The uneven gripping surface on the palm side of the glove, such as indicated in FIG. 11A can be generated by a process in which a photo sensitive material is placed on the interior of the mold in a preselected pattern. The mold is then etched with acid. The etching process is repeated until the final texture of the palm side of the glove is achieved.

I claim:

1. A webbed glove for use in controlling hand movement through a fluid comprising:

A) a main portion that includes
(1) a wrist-covering section,
(2) a body section, and
(3) a plurality of proximal phalange-covering sections;

B) a plurality of webs connecting adjacent phalange-covering sections together, each web having a front edge, a rear edge, side edges, a top surface, a bottom surface and a web thickness measured between said top surface and said bottom surface;

C) a plurality of fins extending on said body section and on each of said phalange-covering sections, said fins being raised above the outer surface and said main portion;

D) a groove defined in each web and extending from said front edge to adjacent to said rear edge and being arcuate in shape and having a thickness that is less than said web thickness permitting the webs to fold when a web is compressed from the side edges; and E) closure means on said wrist-covering section.

2. The glove as defined in claim 1 wherein the closure means comprises a hook-and-loop fastener.

3. The glove as defined in claim 2 wherein the closure means further comprises a first strap attached to one end to said wrist-covering section and a second strap connected at one end to said wrist-covering section at a location spaced from said first strap.

4. The glove as defined in claim 3 wherein the second strap covers the first strap when said first and second straps are closed.

5. The glove as defined in claim 3 wherein the closure means straps each include a proximal end located adjacent to each other.

6. The glove as defined in claim 1 wherein the main portion comprises two layers which include an inner layer and an outer layer.

7. The glove as defined in claim 6 further comprising a pocket means located on the closure means of the main portion for releasably mounting accessories on said closure means.

8. The glove as defined in claim 1 wherein each fin of the plurality of fins includes a top edge spaced from the main portion of said glove.

9. The glove as defined in claim 8 wherein the top edge of each fin of the plurality of fins is an irregular surface.

10. The glove as defined in claim 8 wherein the top edge of each fin of the plurality of fins is sloped.

11. The glove as defined in claim 1 wherein each fin of the plurality of fins includes a plurality of sections.

12. The glove as defined in claim 1 wherein the fins extend on a top portion of the main portion.

13. The glove as defined in claim 1 further comprising a flow hole located in each web of the plurality of webs.

14. The glove as defined in claim 1 wherein the front edge of each web of the plurality of webs is arcuate.

15. A webbed glove for use in controlling hand movement through a fluid comprising:

A) a main portion that includes
(1) a wrist-covering section,
(2) a body section, and
(3) a plurality of proximal phalange-covering sections;

B) a plurality of webs connecting adjacent phalange-covering sections together;

C) a fluid flow hole located in each web of said plurality of webs;

D) a plurality of fins extending on said body and on each of said phalange-covering sections, said fins being raised above the outer surface of said main portion;

E) a concave groove means having an arcuate wall defined in each web on the side of the web opposite the palm side of said plurality of webs and extending adjacent to and past said flow hole in each web from the distal end towards the proximal end of each web of said plurality of webs for increasing the flexibility of each web; and F) closure means on said wrist-covering section for closing said wrist-covering section.

16. A process for forming a webbed glove for use in controlling hand movement through a fluid comprising a main portion that includes a wrist-covering section, a body section, and a plurality of proximal phalange-covering sections; a plurality of webs connecting adjacent phalange-covering sections together, each web of said plurality of webs having a front edge, a rear edge, side edges, a top surface, a bottom surface and a web thickness measured between said top surface and said bottom surface; a plurality of fins extending on said body and on each of said phalange-covering sections, said fins being raised above the outer surface of said main portion; a groove defined in each web and extending from said front edge to adjacent to said rear edge and being arcuate in shape and having a thickness that is less than said web thickness permitting the webs to fold when a web is compressed from the side edges; and closure means on said wrist-covering section, comprising steps of combining closed cell neoprene with loose fibers disposing the materials in a mold, and molding said materials together to form a one-piece glove.

17. The process defined in claim 16 further including the steps of contacting the interior surface of the mold with a photo sensitive material in a predetermined pattern and etching the mold before molding the materials together.

* * * * *